US007273150B2

(12) United States Patent
Fridman et al.

(10) Patent No.: US 7,273,150 B2
(45) Date of Patent: Sep. 25, 2007

(54) PORTABLE SCREENING MACHINE

(75) Inventors: Boris Fridman, York, PA (US); Jerry L. Warlow, Lebanon, PA (US)

(73) Assignee: Wildcat Manufacturing Co., Inc., Freeman, SD (US)

( * ) Notice: Subject to any disclaimer, the term of this patent is extended or adjusted under 35 U.S.C. 154(b) by 330 days.

(21) Appl. No.: 10/747,376

(22) Filed: Dec. 29, 2003

(65) Prior Publication Data

US 2006/0237346 A1 Oct. 26, 2006

(51) Int. Cl.
*B07B 1/00* (2006.01)
*B07B 1/22* (2006.01)

(52) U.S. Cl. ..... 209/241; 209/288; 209/420; 209/930; 198/313; 198/317; 198/318

(58) Field of Classification Search ..... 198/581, 198/861.1, 312, 313, 314, 315, 316.1, 317, 198/318, 632, 861.2; 209/291, 253, 296, 209/297, 240–244, 247, 255, 257, 284, 288, 209/409, 420, 421, 930
See application file for complete search history.

(56) References Cited

U.S. PATENT DOCUMENTS 2,609,115 A 9/1952 Oklejas
3,884,346 A 5/1975 O'Neill et al.
4,031,976 A 6/1977 Lambert
4,058,198 A 11/1977 O'Neill et al.
4,063,375 A * 12/1977 Satterwhite ..... 37/190
4,206,840 A * 6/1980 Hanson ..... 198/301
4,303,506 A 12/1981 Finlay
4,512,687 A * 4/1985 Enns ..... 406/41
4,624,357 A 11/1986 Oury et al.
4,983,280 A 1/1991 Eriksson (Continued)

FOREIGN PATENT DOCUMENTS

CA 2094518 10/1997

(Continued)

OTHER PUBLICATIONS

Wildcat MFG. Co., Inc., Sales Literature consisting of Drawings and Diagrams for Wildcat Trommel Screen Model RHC 6-160 Screening Plant, Mar. 1991, pp. 1, WC677, WC694, Wildcat Mfg. Co., Inc., USA.

(Continued)

*Primary Examiner*—Patrick Mackey
*Assistant Examiner*—Mark Hageman
(74) *Attorney, Agent, or Firm*—James E. Cole; John F. Salazar; Middleton Reutlinger

(57) ABSTRACT

A portable screening trommel having a chassis, at least one wheel assembly at a rear portion of the chassis, a hopper for receiving a material, a rotary trommel being chain driven at a discharge end and which receives the material from a feed conveyor beneath the hopper, a first product conveyor extending from a rearward end of the chassis to a forward end and feeding a rotatable stacking conveyor, and a second product conveyor receiving material from within the trommel and being rotatable between an operating position and a traveling position. The stacking conveyor is positioned at the forward end of the chassis and is rotatable between a first operating position and a second traveling position.

19 Claims, 7 Drawing Sheets

U.S. PATENT DOCUMENTS

| | | | | |
|---|---|---|---|---|
| 4,997,135 | A | 3/1991 | Zehr | |
| 5,193,971 | A | 3/1993 | Pettijohn | |
| 5,234,564 | A | 8/1993 | Smith | |
| 5,248,042 | A | 9/1993 | Kuhmonen | |
| 5,285,905 | A | 2/1994 | Laprade | |
| 5,332,052 | A | 7/1994 | Carnevale | |
| 5,333,725 | A * | 8/1994 | Douglas | 198/632 |
| 5,474,816 | A | 12/1995 | Fulghum, Jr. et al. | |
| 5,577,618 | A | 11/1996 | Rafferty | |
| 5,749,452 | A * | 5/1998 | Kanenwischer | 198/301 |
| 5,819,950 | A * | 10/1998 | McCloskey | 209/241 |
| 6,290,153 | B1 | 9/2001 | Prox | |
| 6,360,876 | B1 * | 3/2002 | Nohl et al. | 198/588 |
| 6,360,894 | B1 | 3/2002 | Devlin et al. | |
| 6,543,622 | B1 | 4/2003 | Fridman | |
| 6,910,586 | B2 * | 6/2005 | McCloskey | 209/241 |
| 2002/0195310 | A1 * | 12/2002 | Lischynski et al. | 198/311 |

FOREIGN PATENT DOCUMENTS

| | | |
|---|---|---|
| GB | 2175559 | 12/1986 |
| GB | 2200613 | 8/1988 |

OTHER PUBLICATIONS

Wildcat MFG. Co., Inc., Sales Literature consisting of Drawings and Diagrams for Wildcat Trommel Screen Model RHC 6-160 Screening Plant, Feb. 1991, p. WC680, Wildcat Mfg. Co., Inc., USA.

Wildcat MFG. Co., Inc., Sales Literature consisting of Drawings and Diagrams for Wildcat Trommel Screen Model RHC 6-160 Screening Plant, Apr. 1991, pp. WC677 and 207-218, Wildcat Mfg. Co. Inc., USA.

Wildcat MFG. Co., Inc., Sales Literature consisting of Drawings and Diagrams for Wildcat Trommel Screen Model RHC 6-160 Screening Plant, pp. WC658,WC661 and WC662, Jan. 1991, Wildcat Mfg. Co. Inc., USA.

Wildcat MFG. Co., Inc., Sales Literature consisting of Drawings and Diagrams for Wildcat Trommel Screen Model RHC 6-160 Screening Plant, p. WC1420, Aug. 1993, Wildcat Mfg. Co. Inc., US.

RE-TECH dated engineering drawing (May 25, 1994), Sales Literature from Re-Tech depicting trommel with two double folding conveyors, Photos of Eliminator Device built Jul. 1994 having seral No. 1R9TE472XRY216016, Figures 1-11, Re-Tech (a division Enviroquip Systems Inc.), USA.

RE-TECH dated engineering drawing (May 25, 1994), Sales Literature from Re-Tech depicting trommel with two double folding conveyors, Figure 12 is a Re-Tech drawing #E-32 depicting double-fold fines stacker option available before Apr. 5, 1995, Re-Tech (a division Enviroquip Systems Inc.), USA.

RE-TECH dated engineering drawing (May 25, 1994), Sales Literature from Re-Tech depicting trommel with two double folding conveyors, Figure 13 is Sales Literature published before Apr. 5, 1995 from Re-Tech depicting double-pivoting conveyors in stowed position, Re-Tech (a division Enviroquip Systems Inc.), USA.

Royer Industries Inc., Royer 616 MP advertisement, Biocycle Magazine, May 1991 p. 19-23, Figure 1-5, JG Press, Inc., USA.

Royer Industries Inc., Royer 616 MP advertisement, Biocycle Magazine, Feb. 1993, p. 6, Figure 6, JG Press, Inc., USA.

Royer Industries Inc., Royer 616 MP article, Biocycle Magazine, Mar. 1993, p. 47, Figure 7, JG Press, Inc., USA.

Royer Industries Inc., Royer 616 MP article, Biocycle Magazine, Sep. 1994, p. 50, Figure 8, JG Press, Inc., USA.

Royer Industries Inc., Sales Literature for Royer 616 MP depicting the folding feature of the conveyor, D 1402-2680, Figure 9, Royer Industries Inc, USA.

Diamond Z Manufacturing, Diamond Z Device advertisement, Biocycle Magazine, Apr. 1995, p. 14, Figure 1, JG Press, Inc., USA.

RE-TECH dated engineering drawing (Mar. 2, 1994) Figure 1 and Figure 2 as enlarged version, The Landscaper Device drawing L01, Re-Tech (a division of Enviroquip Systems Inc.) USA.

RE-TECH Sales Literature for the Roto-Screen depicting a plurality of screening devices which utilize stockpiling conveyors at the end of the chassis opposite the rotary trommel, located in U.S. Patent No. 5285905, Figures 3-8, Mar. 2, 1994, Re-Tech (a Division of Enviroquip Systems Inc.) USA.

Lekopa OY Sales Literature depiction the Remu Device which is used for screening materials, Figures 1-8, Lekopa OY, Finland.

The Trommel 615, Sales Literature and Drawings for Powerscreen Trommel 615 Specification.

Iowa Manufacturing Company (a Raytheon Company), Model 5348-VGF-FS Portable Impact Breaking with Front Swivel Conveyor, Cedarapids brochure, Section 17—Division 1—Form No. 13757-IMCO-10-73, Iowa Manufacturing Company (a Raytheon Company), USA.

Iowa Manufacturing Company (a Raytheon Company), Hydraulic Swivel Base Parts List No. 8085KAP, Cedarapids Parts Manual, Oct. 1990, p. XS76-159, Iowa Manufacturing Company {a Raytheon Company}, USA.

Iowa Manufacturing Company (a Raytheon Company), Components, Cedarapids Parts Manual, Jul. 1992, p. XS29E-1, Iowa Manufacturing Company (a Raytheon Company), USA.

Iowa Manufacturing Company (a Raytheon Company), Elevating System &Swivel Mounting, Cedarapids Parts Manual, Jul. 1992, p. XS29E-14, Iowa Manufacturing Company (a Raytheon Company), USA.

Iowa Manufacturing Company (a Raytheon Company), Elevating System &Swivel Mounting Part List No. 5400CD & 5400CF, Cedarapids Parts Manual, Jul. 1992, p. XS29E-14, Iowa Manufacturing Company (a Raytheon Company), USA.

Iowa Manufacturing Company (a Raytheon Company),Portable and Radial Stacking Conveyor Stockpile Tonnage, Cedarapids Parts Manual, Sales Manual Specification sheet, p. Section 5—Division 3—Form 125630IMCO-9-69, Iowa Manufacturing Company (a Raytheon Company), USA.

* cited by examiner

PORTABLE SCREENING MACHINE

FIELD OF THE INVENTION

The present invention relates to a portable system for screening materials comprising a rotary trommel which is chain driven at a discharge end thereof and has a stacking conveyor belt at a forward end of the portable screening machine which may be a radial stacker for use with the portable screening machine or used solely as a stand alone conveyor.

DETAILED DESCRIPTION OF THE PREFERRED EMBODIMENTS

Figure 1:
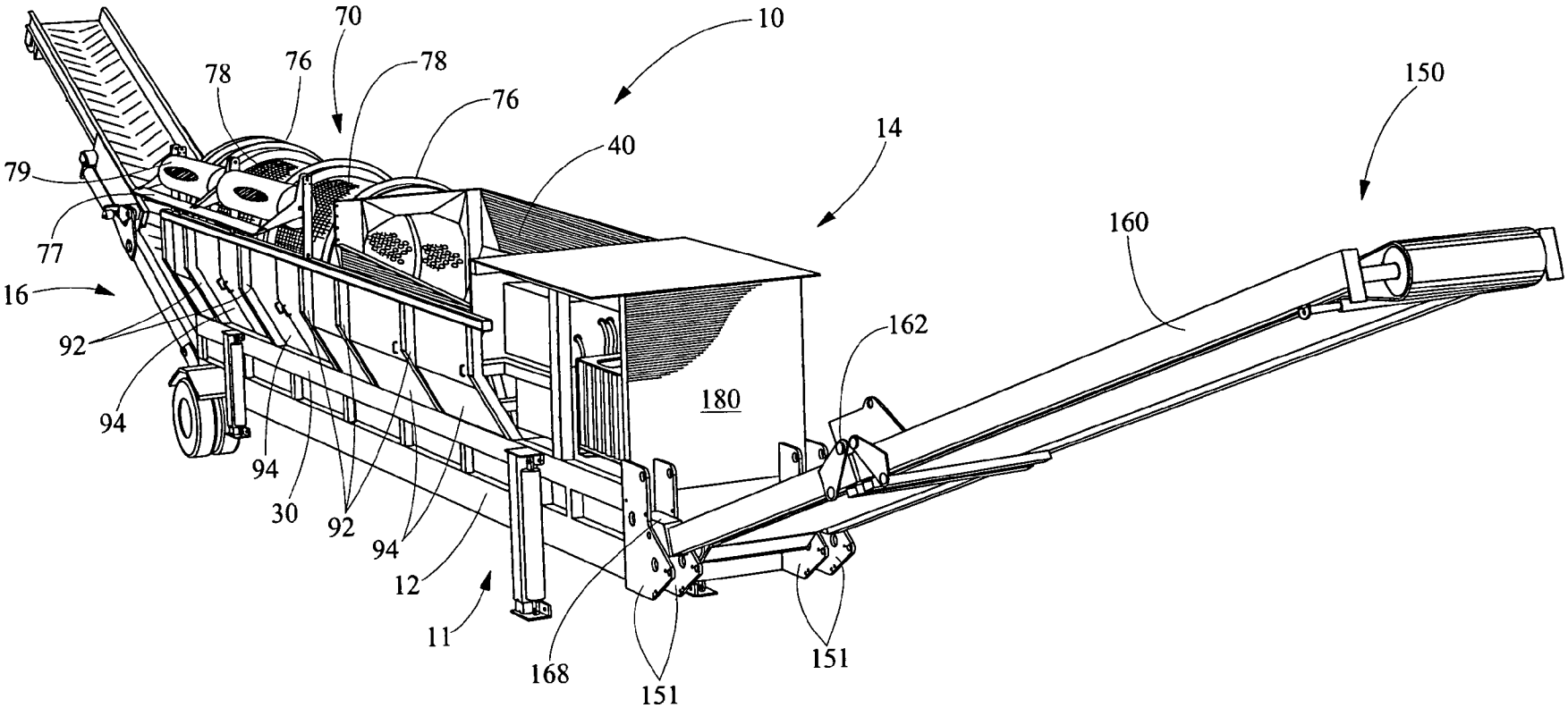
FIG. 1 is a perspective view of the portable screening machine of the instant invention.

The portable screening machine 10 of the present invention depicted in the drawings provides a rotary trommel, which is driven by a chain and sprocket arrangement at a discharge end of the trommel. According to one embodiment depicted in FIGS. 1-7, a portable screening machine 10 is depicted having a chassis 11 defined by at least a lower frame portion 12 and an upper frame portion 30. As depicted in the instant embodiment the lower frame portion 12 and the upper frame portion 30 may be formed of channel beams or other suitable structure separated by a plurality of structural ribs. The chassis 11 comprises a forward end 14, where a tractor or other towing machine may be connected to the portable screening machine 10, and a rearward end 16. Depending from the rearward end 16 may be a suspension 18. Rotatably connected to the suspension 18 may be wheel assemblies 28 providing a means for transporting the screening machine 10 to and from various positions. The suspension 18 may further comprise a strut for stiffening the machine 10 during travel. It should be understood that it is well within the contemplation of the instant invention that various types of suspension systems may be implemented herewith including coil springs, air bladders, or other known suspensions.

Connected about the periphery of the chassis 11 are a plurality of legs 34. The legs 34 each have a nested inner leg portion 36 therein which may be extended between an operating position, shown in FIG. 3 and a traveling position, shown in FIG. 2. At a lower portion of each inner leg 36 is a foot 37 providing a stable platform from which the screening machine 10 operates when the inner leg portion 36 is extended. Connected to mounting lugs 42 on each leg 34 and substantially parallel to each leg 34 are cylinders 38. The cylinders 38 may be air cylinders, hydraulic, or some other type fluid driven cylinder. The cylinders 38 are connected at an upper end to the upper frame portion 30. Slidably positioned within each cylinder 38 is a piston 40 which is connected to the foot 37 and provides for movement of the foot 37 and inner leg portion 36 between the operating position and the traveling position. Preferably, the inner leg portions 36 are extended downward so that the feet 37 can fully support the portable screening machine 10 during operation.

Referring now to FIG. 1, mounted above the upper frame portion 30 is a hopper 40. The hopper 40 has an open upper portion, an open lower portion, and tapered sidewalls such that the upper portion has a larger perimeter and cross-sectional area than the lower portion. The hopper 40 may be formed of various materials including but not limited to steel plate, rubber lined steel plate, diamond plate, other abrasion resistance steel plate or polymeric material depending on the products being screened and sized using the screening machine 10. The hopper 40 receives material from a conveyor belt, front end loader, or other industrial equipment and directs the material to a feed conveyor 52 disposed beneath the hopper 40 and best shown in FIG. 2. The hopper 40 may further comprise a grate extending across upper open portion in order to break up clumps of material before they reach the feed conveyor 52.

Figure 2:
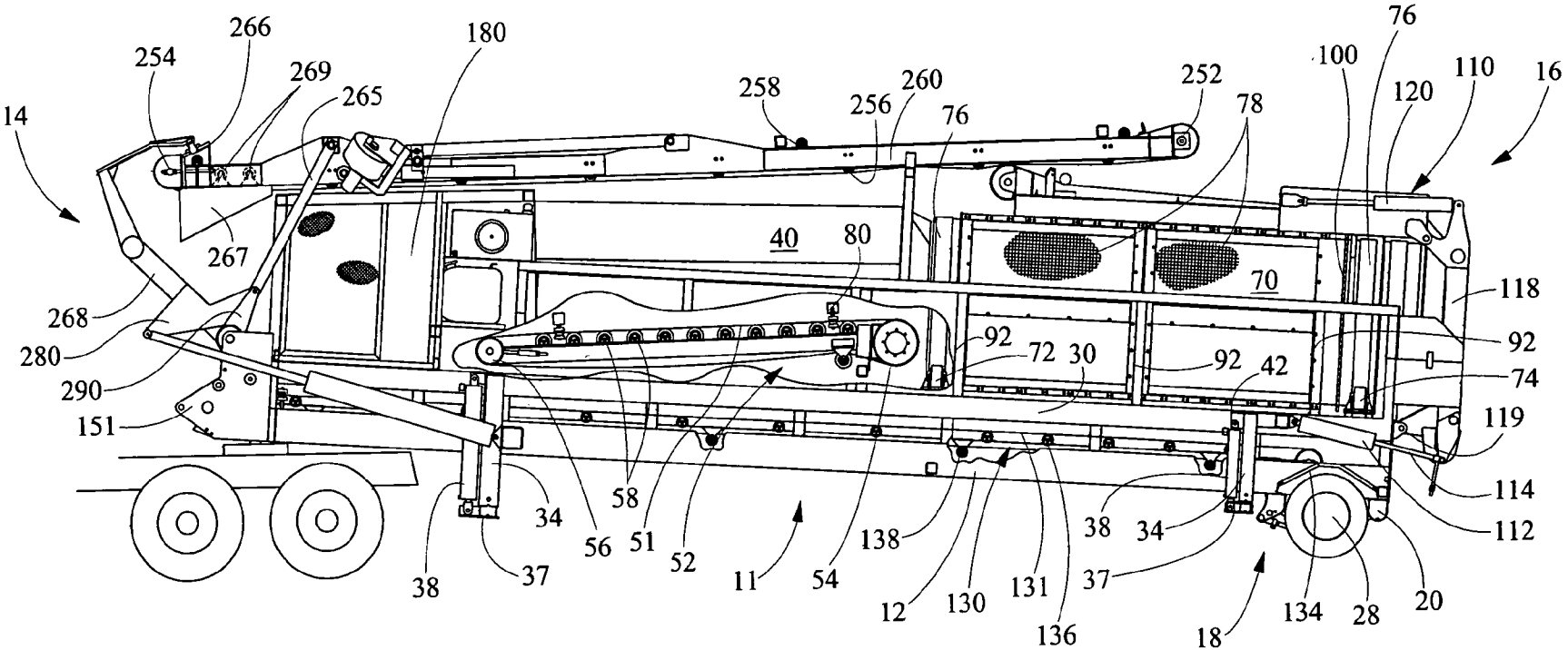
FIG. 2 is a side view of the portable screening machine of FIG. 1.

Still referring to FIG. 2, the feed conveyor 52 includes a belt 51 extending between a head pulley 54 and a tail pulley 56 and comprises a plurality of idling rollers 58 for supporting a bed of material being moved by the feed conveyor 52. The feed conveyor 52 may also include at least one return roller for engaging the return side of the conveyor 52 and providing some tension in the belt. In addition, the feed conveyor 52 may further include centering rollers 80 inhibiting the feed conveyor from "walking" or "creeping" along the idling rollers 58 beyond a predetermined tolerance. In addition, a chute may extend between the feed conveyor 52 and a lower edge portion of the hopper 40 in order to keep dust at a minimum and inhibit material spillage at the transfer point between the hopper 40 and the feed conveyor 52.

Figure 4:
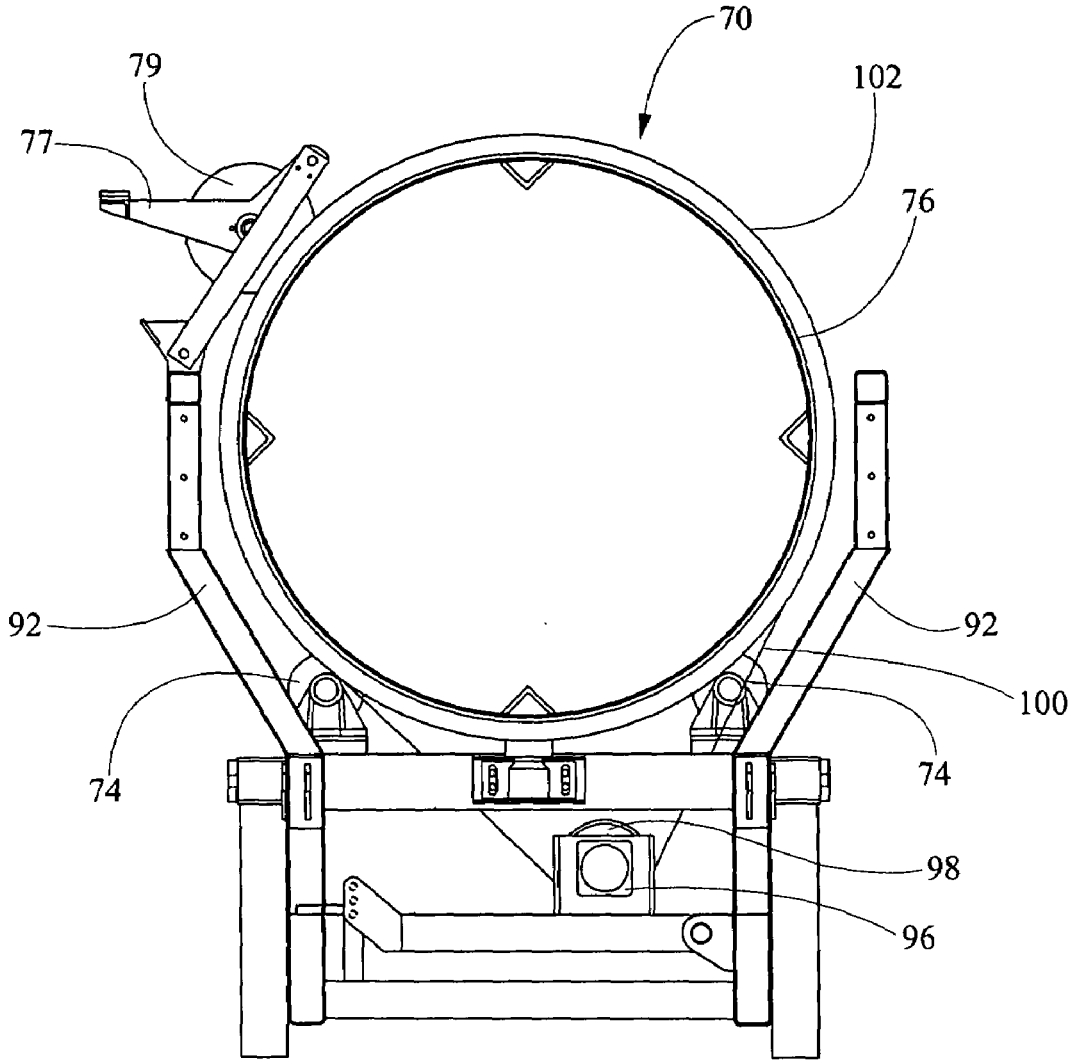
FIG. 4 is a rear view of the portable screening machine showing the motor and chain drive at the discharge end.

Referring now to FIGS. 1, 2, and 4, at the discharge end of the feed conveyor 52 near the head pulley 54 is cylindrical screening machine, which is also known as a rotary screening trommel 70 in the industry. The rotary trommel 70 is substantially cylindrical in shape having a feed end receiving material from the feed conveyor 52 and a discharge end at a rearward portion of the chassis 11. The rotary trommel 70 is oriented so that the feed end is higher than the discharge end. This may be accomplished by raising the forward end 14 of the machine 10 to a higher elevation than the rearward end 16, or raising the feed end of the trommel 70 higher than the discharge end. In either event, it is preferable to have the feed end of the trommel 70 higher than the discharge end so that material moves from one end to the opposite end during rotation of the trommel 70. The rotary trommel shape is defined by a screening material 78 having a preselected screen size which allows material less than the preselected size to fall there through while retaining oversized product material within the trommel 70 for continuous removal at the discharge end. The screening material is preferably formed of a steel mesh having a preselected wire size and aperture size dependent upon sizing characteristics desired for the material. The screening material 78 may also be corrosion resistant if such a characteristic is desired. The rotary trommel 70 is rotatably positioned on a plurality of bearing assemblies, preferably four, each having either a forward roller 72 or a rearward roller 74 and allowing rotation of the trommel 70. According to the instant design two forward rollers 72 and two rearward rollers 74 are used to support the trommel 70. At least one trommel ring 76 extends about the trommel 70 at forward and rearward ends and each is aligned for rotation on the forward and rearward rollers 72,74. In addition, a thrust bearing may be used near a lower discharge end of the trommel 70 since the trommel is oriented having a downward slope from the feed end to the discharge end.

As shown in FIGS. 1 and 4, at least one brush 79 is shown rotatably contacting the trommel 70, and more specifically the trommel screen 78. The at least one brush 79 preferably has a plurality of bristles which clear the trommel screen 78 to provide proper screening during operation. The brush 79 is rotatably connected to a structural arm 77 which properly spaces the brush 79 from the trommel screen 78 for proper operation during screening. A scraping device may also extend from the structural arm 77 to clear clumps of material from the rotary screening trommel 70.

Figure 5:
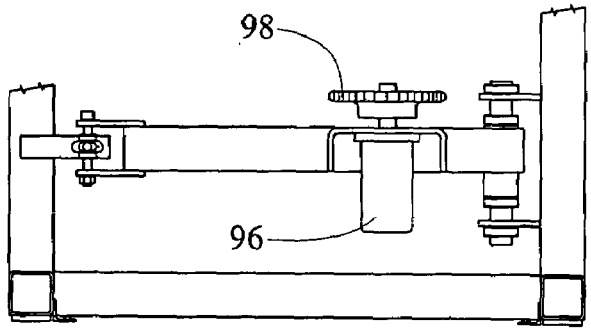
FIG. 5 is a top view of the motor and drive sprocket configuration of FIG. 4.

Referring now to FIGS. 2, 4, and 5, the rotary trommel 70 is rotated by a chain drive positioned at a rearward or discharge end of the trommel 70. Extending about the trommel 70 adjacent the rearward roller ring 76 is a trommel sprocket 102. A motor 96 is disposed on the chassis 11 above the suspension 18 at the rearward end portion of the chassis 16. The motor 96 has a shaft with a sprocket 98 aligned with the trommel sprocket 102. A chain 100 extends about the motor sprocket 98 and trommel sprocket 102 so that the motor 96 can drive the rotary trommel 70.

The rear chain drive configuration of the present invention provides two distinct advantages over prior art trommels which do not include rear chain drive configurations. The rear drive configuration has a low primary load height which is very important in the screening industry. Prior art screening machines are not rear drive systems as in the present invention. In order to provide clearance for prior art drives, the drum must be raised which requires that conveyors and hoppers also be raised. By raising the hopper, larger front end loading equipment is required which is very expensive and may be cost prohibitive.

To the contrary, the present invention overcomes these problems and provides several advantages. First, by relocating the chain drive to the rear end of the trommel 70, the hopper 40 and in-feed conveyor 52 are lowered to provide a lower primary load height which does not require larger loaders. Second because the hopper 40 is lowered, a larger hopper 40 may be used than in prior art designs. Third, a maintenance panel may be provided at the rear of the screening machine 10 to provide access to the chain drive for maintenance rather than having maintenance personnel laying on an undersize product belt 130 to perform maintenance on the drive. Fourth, the rear chain drive configuration allows a lower height for the trommel 70 which may relate to a lower height for the undersized conveyor 130 providing clearance between the undersized product conveyor 130 and the in-feed conveyor 52. Finally, the rear chain drive configuration allows for lower undersized product belt height providing additional clearance between the lower portion of trommel 70 and the material piles on the undersized product belt 131.

Referring now to FIGS. 1 and 2, at a discharge end of the trommel 70 is an oversized product conveyor 110 receiving oversized material which fails to pass through the screening material 78. The oversized product conveyor is rotatably connected to the chassis 11 such that the conveyor 110 may be pivoted upward about a horizontal axis through connection 119 into a traveling position or for storage shown in FIG. 2 or pivoted downward and extended for operation shown in FIG. 1. The oversized product conveyor 110 includes a head pulley for driving the conveyor and tail pulley and may also include idling rollers, return rollers, and tensioning rollers. The oversized product conveyor 110 is preferably driven by a motor and drive wherein the motor may be a hydraulic motor or an electric motor and the drive may be a belt drive, chain and sprocket drive, gear reducer, or other known drive system for transmitting torque from the motor to the conveyor 110. The oversized product conveyor 110 comprises a first cylinder 112 having a piston 114 slidably extending from the cylinder 112. The first cylinder 112 may be pivotably connected on the chassis 11 and the piston 114 has a distal end 114 connected to a conveyor support arm 118. When the piston 114 is extended the conveyor 110 pivots about connection 119 to an upper folded and stored position depicted in FIG. 2. However, when the piston 114 is retracted the conveyor support arm 118 pivots about connection 119 into an extended operational position depicted in FIG. 1. At an opposite second end of the conveyor support arm 118, is a second cylinder and piston 120. The second cylinder-piston arrangement 120 is disposed in an extended position when the conveyor 110 is in a stored position but moves to a retracted position when the conveyor 110 may be moved to an extended operating position. In such an extended position, the oversized product conveyor 110 is inclined or directed in an upward direction to allow for stacking of the oversized product received from the rotary trommel 70. Alternatively, the orientation of the oversized product belt 110 may be adjusted to extend horizontally or downward if desired. According to at least one embodiment, the oversized product conveyor 110 is driven by a hydraulic motor although it is well within the scope of the present invention to use an electric motor.

Figure 3:
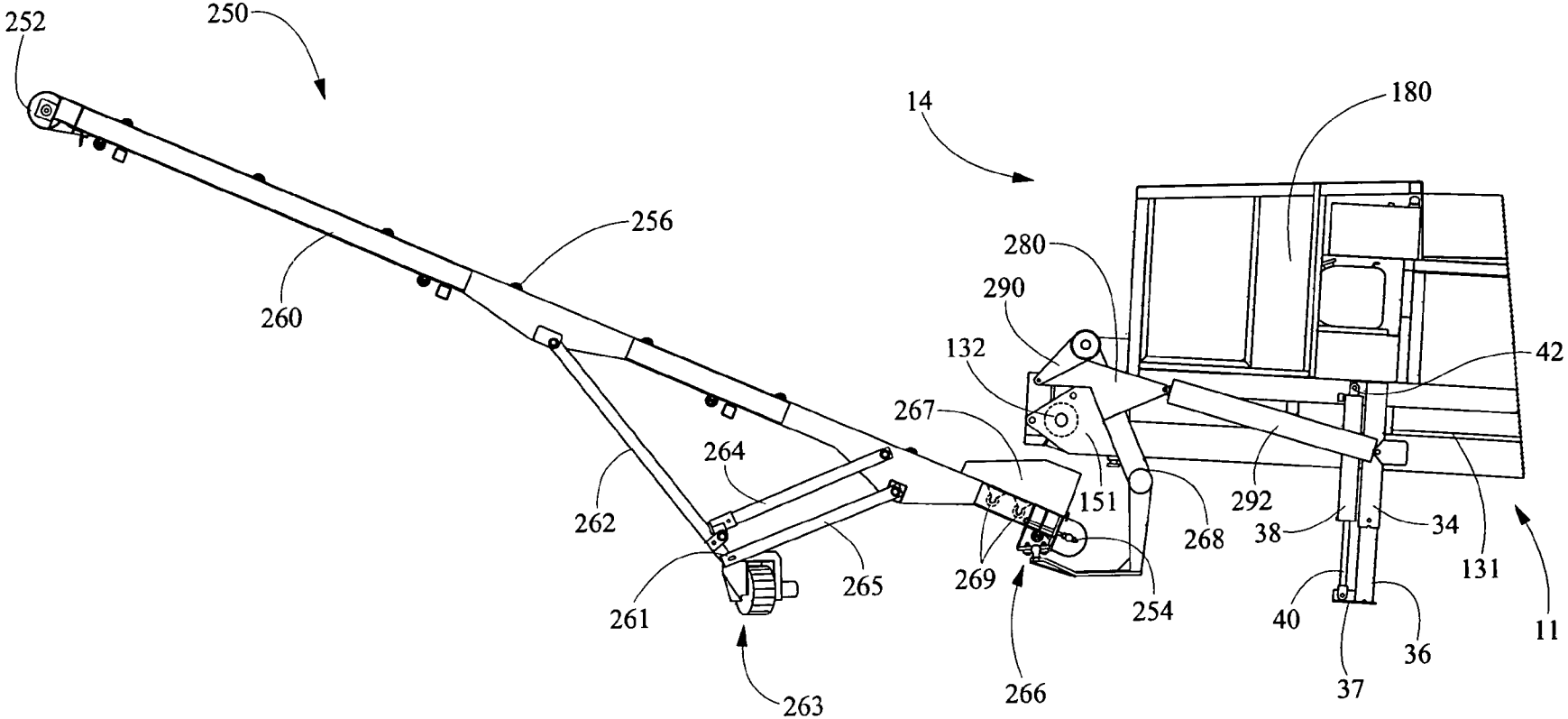
FIG. 3 is a side view of a forward portion of the portable screening machine of FIG. 1 with a radial stacker in an extended operating position.

Referring now to FIGS. 2 and 3, extending from the rearward end 16 of the chassis 11 to the forward end 14 is the undersized product conveyor or fines conveyor 130 located beneath the trommel 70 and receiving undersized material which passes through the screen 78. The undersized product conveyor 130 comprises a head pulley 132 at a forward end 14 of the chassis 11, a tail pulley 134 at a rearward end 16 of the chassis 11, idler rollers 136, and return rollers 138. The head pulley 132 and/or tail pulley 134 may also have a turnbuckle or other tensioning device in order to adjust the tension on the undersized product belt 131. The undersized product conveyor 130 is preferably driven by a motor and drive wherein the motor may be a hydraulic or electric motor and the drive may be a belt drive, chain and sprocket drive, gear reducer, or other known drive system for transmitting torque from the motor to the conveyor 130.

Referring now to FIGS. 1-3, a second embodiment of the present invention is depicted. In addition to the rear drive trommel design previously discussed, the portable screening machine 10 also comprises either a permanently attached stacker 150 as shown in FIG. 1, or a removable radial stacker 260 as shown in FIGS. 2 and 3, such that either configuration may be provided to an end user. Referring first to FIG. 1, extending from the forward end 14 of the chassis 11 are first and second pairs of pivot plates 151 which may be used to connect either the radial stacker 250 or the non-radial stacking conveyor 150 to the portable screening machine 10. Still referring to FIG. 1, the first exemplary embodiment of the alternative stacking devices comprises the non-radial stacking conveyor 150 which is pivotably connected between each pair of pivot plates 151. Pivotably attached to the pivot plates 151 is a first embodiment of a pivoting stacker arm 168 for upward and downward pivotal rotation about a horizontal axis. The stacker arm 168 pivots at the pivot plate 151 such that the radial stacking conveyor 150 may be directed upwardly through a range of angles to permit stacking of undersized product at various heights. The stacker conveyor 150 also comprises a hinge 162 in the conveyor frame providing pivoting about a horizontal axis for folding the conveyor during storage or travel.

Referring now to FIGS. 2, 3, 6, and 7, an exemplary removable radial stacking conveyor 250 and support structure is shown wherein the stacking conveyor 250 may be used either with the portable screening machine 10 or as a stand-alone stacking conveyor separate from the portable screening machine 10. The radial stacking conveyor 250 preferably has a range of motion through a horizontal plane of up to about 200 degrees when attached to a stacking arm 268 of the portable screening machine 10. Prior art radial stackers which are integral with a screening machine have typically been limited to less than 180 degrees of rotation. However, the structure of the present design does not limit rotation to 180 degrees but instead allows a greater range of rotation. Pivotably connected to the pivot plates 151 is a second embodiment of a stacking arm 268 having an integral lever arm 280 and shaft collar 290. According to the second embodiment of the stacking conveyor, the stacking arm 268, the shaft collar 290 and lever arm 280 are welded together to provide a unitary structure. The stacking arm 268, lever arm 280, and shaft collar 290 are connected to the pivot plates by a shaft 291 allowing pivotal rotation of the radial stacker 250 about a horizontal axis defined by the shaft 291 such that the radial stacking conveyor 250 can rotate upward about a horizontal axis. Hereinafter, referral to the stacking arm 268 can be assumed to also include referral to the shaft collar 290 and lever arm 280. The stacking arm 268 is connected to the pivot plates 151 at a higher pivoting position on the plates 151 than the first embodiment stacker 150 as best shown in FIG. 3 in order to provide clearance for parts disposed beneath the radial stacker 250. Disposed at a lower portion of a stacker arm 268 is a ball-joint 266 providing for a pivoting movement about a vertical axis between the stacking arm 268 and the stacking conveyor 250. Thus, the stacking arm 268 in combination with the ball-joint 266 provide for movement of the conveyor 250 about a horizontal axis and about a vertical axis. Disposition of the ball-joint 266 at a lower portion of stacking arm 268 allows greater rotation than available with prior art machines such that the stacking conveyor 250 does not come into contact with the chassis 11 as readily as prior art machines. The radial stacking conveyor 250 comprises a frame 260 having a head pulley 252 at a first end and a tail pulley 254 at a second end. The frame 260 is formed of a plurality of structural beams which may be, for instance, I-beams or channel beams. Extending upwardly from the frame 260 between the head pulley 252 and tail pulley 254 are a plurality of idler rollers 256 for supporting a load of material being conveyed along the stacking conveyor 250. Also extending upward from the frame 260 may be a fines conveyor hopper 267 which, in the operating position shown in FIG. 3, is located beneath the head pulley 132 of the undersized product belt 130. In this configuration the fines conveyor hopper 267 inhibits spillage of material from the transfer between the undersized product belt 130 and the stacking conveyor 250 and further contains dust. The fines conveyor hopper 267 may be formed of various abrasion resistant materials including but not limited to rubber, synthetic rubber, abrasion resistant molded polymeric materials, steel, or abrasion resistant steel. Within the area surrounded by the hopper 267 and beneath conveyor belt 250 is at least one support roller 269 which support the stacking conveyor belt 250 as material is dumped thereon. Depending from a lower side of the frame 260 is at least one return roller 258 providing tension on the conveyor belt and inhibiting excessive sagging on the return side. Also depending from the conveyor frame 260 are a plurality of conveyor support beams 262, 264. A first conveyor support beam 262 is pivotably attached to the frame 260 at a first end for pivotal motion about a horizontal axis and a wheel assembly 263 at a second end. Near the second distal end of the beam 262 is a slide block 270 which is attached to the first conveyor support beam 262. A second conveyor support beam 264 is pivotably connected to the conveyor frame 260 at a first distal end, substantially adjacent the tail pulley 254, forming a triangular shaped support structure in combination with the frame 260 and the first conveyor support beam 262. In order to provide for folding of the stacking conveyor 250, the slide block 270 has a collar 271 through which the second conveyor support beam 264 passes in sliding fashion. In other words, the slide block 270 slidably connects the second conveyor support beam 264 to the first conveyor support beam 262. In addition, the collar 271 pivots from the portion 270 in order to provide the folding motion. As shown in FIG. 8, as the stacking conveyor 250 pivots toward an upper stored position, gravity forces the wheel assembly 263 toward the conveyor frame 260 and the second support beam 264 slides through the slide block collar 271 until the conveyor support structure is disposed against the conveyor frame 260 as shown in FIG. 2.

Figure 6:
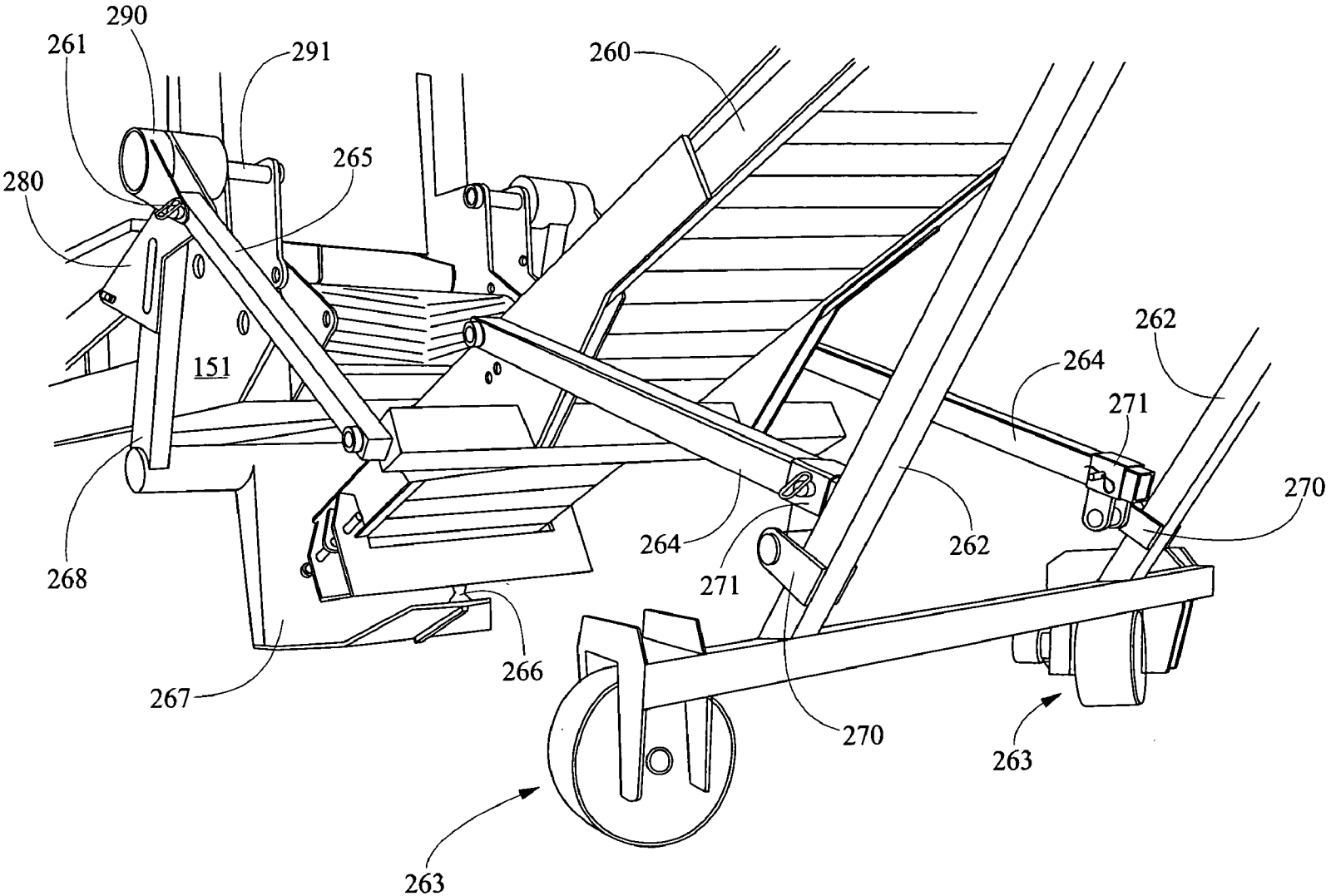
FIG. 6 is a perspective view of the radial stacker support structure.
Figure 7:
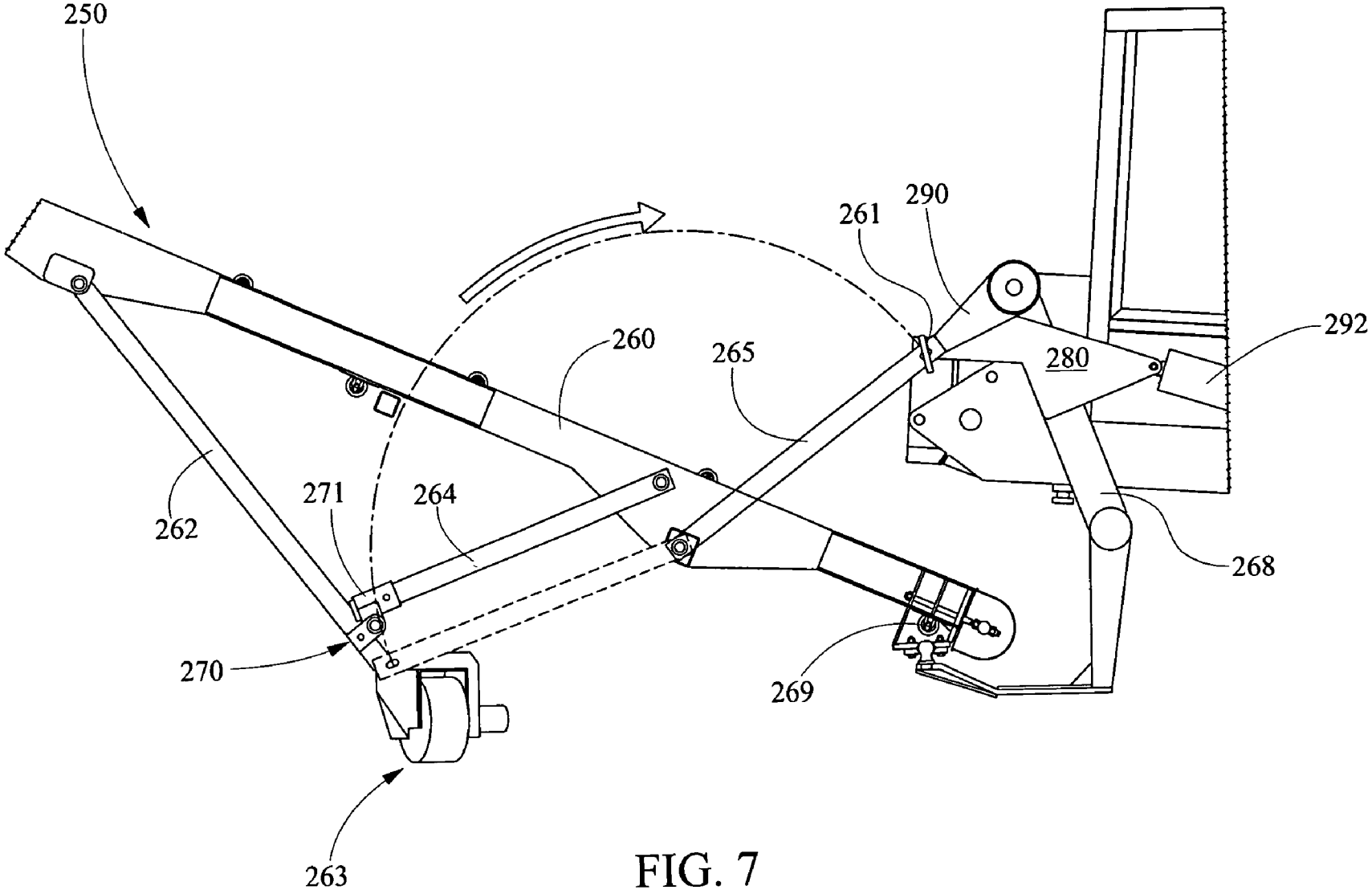
FIG. 7 is side view of the radial stacker support structure.
Figure 8:
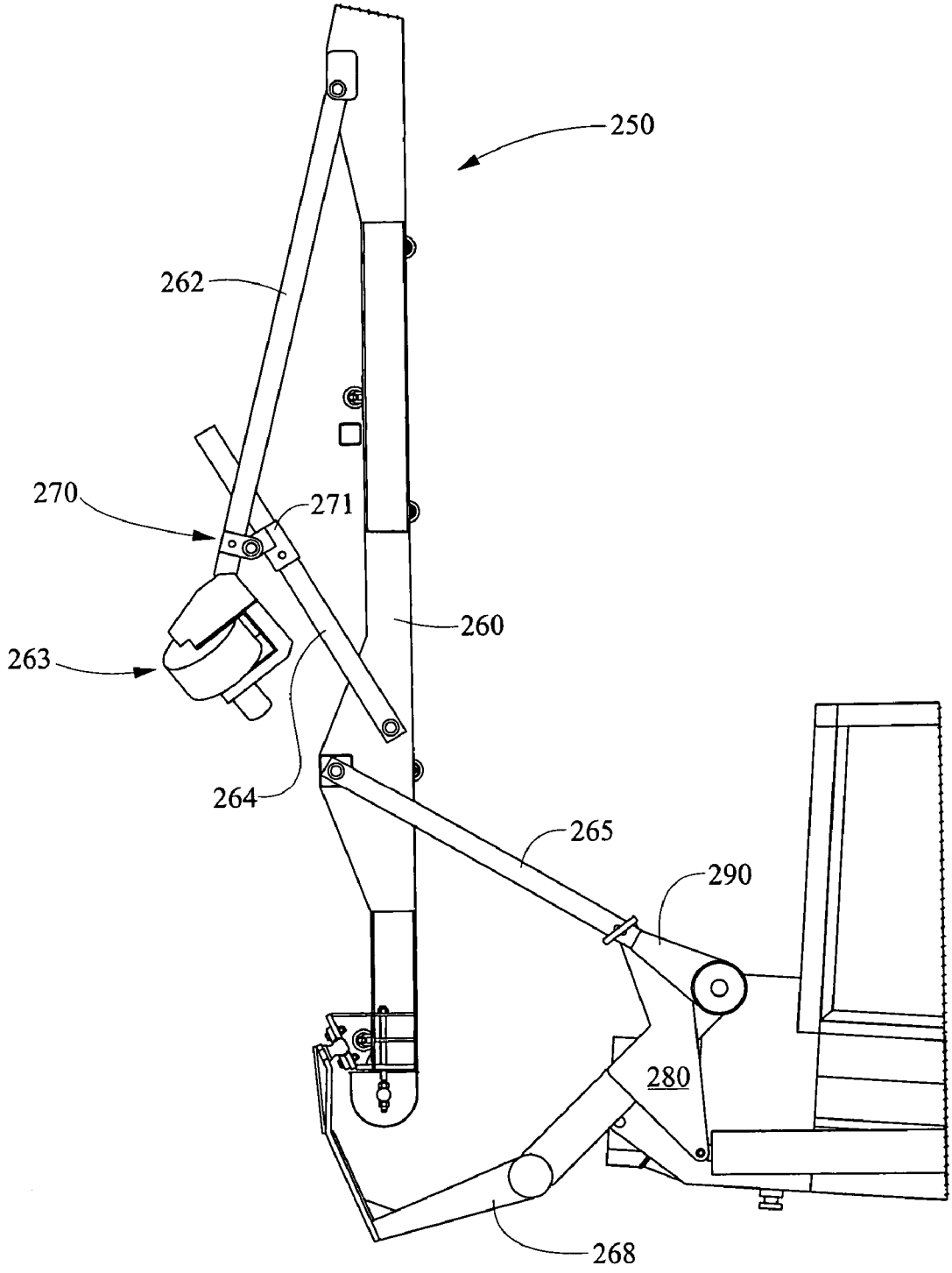
FIG. 8 is a side view of the radial stacker support structure in transition toward an upper position stored position.

Referring now to FIGS. 2, 3, and 6-7, the radial stacker conveyor 250 support structure is shown in various positions. As previously described beams 262,264 provide support for the radial stacker 250 which is shown in the extended operating position in FIG. 3. A stabilizer beam 265 extends from the frame 260 where it is positioned on the wheel assembly 263. The beam 265 need not be connected to the wheel assembly 263 or beam 262 but instead may rest upon wheel assembly 263. The stabilizer beam 265 provides a stabilizing function inhibiting radial movement of the radial stacker 250 about a vertical axis when the radial stacker 250 is pivoted from a transport position to an operating position. The stabilizer beam 265 is pivotably connected to the frame 260 at a distal end so that the beam 265 pivots about a horizontal axis between a first position shown in FIG. 3 and a second position shown in FIGS. 6 and 7. At a second distal end the stabilizing beam 265 has a pin connector 261 which is used to connect the stabilizing beam 265 to a shaft collar 290 with integral lever arm 280 and stacking arm 268. When the stabilizer beam 265 is positioned as shown in FIG. 3, the beam 265 may simply rest on the wheel assembly 263. When the stabilizing beam 265 is positioned as shown in FIGS. 2, 6, and 7, the beam 265 is connected to shaft collar 290 and inhibits the stacker 250 from moving radially about a vertical axis relative to the chassis 11. In this configuration, the stacker 250 may be moved to the stored full-length position or configuration rather than folding the stacker conveyor 250. To allow for such a locked configuration, the stabilizing beam 265 connects to a shaft collar 290 with a pinned connection shown in FIGS. 6 and 7. The shaft collar 290 is connected to a shaft 291 extending from the pivot plates 151 in order to provide rotatable motion. Extending between the stacker arm 268 and the shaft collar 290 is the lever arm 280. The lever arm 280 is connected to a hydraulic cylinder 292 which is disposed in an extended position when the radial stacker 250 is being stored as shown in FIG. 2. When the cylinder 292 is retracted, the radial stacker is moved to an extended operating position. During operation, the cylinder 292 is retracted moving the lever arm 280 and in turn pulling the stacker arm 268 downward as well as the shaft collar 290 downward. As previously describer, the stacker arm 268, shaft collar 290, and lever arm 280 are, according to the present exemplary embodiment, a unitary structure. Once the radial stacker 250 is moved into an operating position, the stabilizing beam 265 is disconnected from the shaft collar 290 by a releasable connection and pivoted to the position shown in FIG. 3 and FIG. 7 in dotted line. When the stabilizing beam 265 is moved to the lower position the radial stacker 250 is released from a locked position and is free to pivot about a vertical axis relative to the chassis 11 at ball-joint connection. When the screening operation is complete the stabilizing beam 265 is moved as shown in FIG. 7 and connected to the shaft collar 290.

According to this embodiment the design allows the rotation of the stacking conveyor 250 for storage or travel as shown in FIG. 2. The conveyor support beams 262, 264, 265 may be formed of various structure shapes including but not limited to channel beams, angle irons, or other shapes. Positioned adjacent the connection of the first and second conveyor support beams 262,264 may be a wheel assembly 263. The wheel assembly 263 allows for radial movement of the stacking conveyor 250 relative to the chassis 11 which in turn provides for larger stockpiles of product.

Located at the forward end of the chassis 11 is a power compartment 180. The power compartment 180 may comprise various pieces of equipment allowing the portable screening trommel to operate self-sufficiently. For example, the power compartment 180 may comprise a diesel engine as well as a hydraulic pump for providing fluid pressure to various hydraulic motors and cylinders. In an alternative embodiment, an electric generator may be located in a power compartment 180 providing power for the various conveyor motors and trommel motor 96. In addition, the power compartment 180 may have an air compressor providing compressed air to an air system for blowing off belts or providing compressed air for other uses.

Extending from the chassis 11, and more specifically the upper frame portion 30, are ribs 92. The ribs 92 extend outwardly a first preselected distance and then upwardly a preselected distance. Extending between the ribs 92 are removable access panels 94 which serve several functions. First, the access panels 94 inhibit hands or other body parts from being injured by contacting moving feed conveyor 52 parts or the rotary trommel 70. Second, the removable panels 94 provide access to various components of the portable screening machine 10 allowing for maintenance and necessary repairs. In addition, the panels contain material spillage from the feed conveyor 52 and rotary trommel 70.

In use, the portable screening machine 10 is connected to a fifth-wheel or other hitch apparatus of a tractor or other towing vehicle at which time it may be towed to a screening location. Once the screening machine 10 is positioned for use, the components located in the power compartment are started providing at least hydraulic fluid power. The inner legs 36 are then lowered by hydraulic cylinders 38 so that the feet 37 stabilize the machine for operation. Once the hydraulic systems are started the oversized product conveyor 110 and the stacking conveyor 150 are lowered from their stored positions to extended operating positions. Next, the conveyor belts are started as well as the motor for the trommel 70. Once the conveyor belts and trommel are operating, the hopper 40 may be loaded by some mobile equipment including a front-end loader, a backhoe, or other such equipment utilizing a bucket. Alternatively, a portable conveyor may be positioned adjacent the screening machine 10 having a discharge end positioned above hopper 40 such that the hopper 40 receives material from the portable conveyor. Once received in the hopper 40, the material is directed to the feed conveyor 52 and further directed into the trommel 70 where the material may be sized according to the screen size of the mesh screening material 78. The oversized material, which does not fit through the screen 78 is stacked to the rear of machine 10 by the oversized product conveyor 110, which receives material from the interior of the trommel 70. The undersized material, which falls through the trommel screen 78 to the undersized product conveyor belt 130, is directed to the front or forward portion 14 to the stacking conveyor 150 or radial stacker 250. Once the screening process is completed, the machine 110 may be cleaned, if necessary, and the stacking conveyor 250 and oversized conveyor 110 moved to stored positions. Finally, the screening machine 10 may be towed to a new position for screening.

It is apparent that variations may be made to the screening machine design of the present invention in regards to specific design elements thereof. Such variations however are deemed to fall within the teachings of the present invention as generally modifications may be made to placement of the particular structure described herein while falling within the general teachings hereof.

We claim:

1. A portable screening machine, comprising:

a chassis having a rotary trommel disposed on said chassis;

an oversized product conveyor at a discharge end of said trommel;

an undersized product belt extending from a rear portion to a forward portion of said chassis, said undersized product belt receiving material from said rotary trommel;

a removable radial stacker conveyor having an input end and an output end, said input end having a first position receiving material from said undersized product belt and a second position wherein said removable radial stacker conveyor is positioned in a substantially horizontal orientation above said chassis and displaced from said undersized product belt;

a folding support structure depending from said removable radial stacker, said folding support structure allowing for standalone support of said removable radial stacker and including a base support allowing radial pivoting of said removable radial stacking conveyor.

2. The portable screening machine of claim 1, said radial stacker rotatably connected to a stacking arm at a forward portion of said chassis.

3. The portable screening machine of claim 2, said stacking arm having a lever arm and a shaft collar integral therewith.

4. The portable screening machine of claim 3, said lever arm connected to a hydraulic cylinder.

5. The portable screening machine of claim 3, said stacking arm and said lever arm pivotably connected to a pivot plate.

6. The portable screening machine of claim 3, said shaft collar connected to said lever arm, said shaft collar releasably connected to a stabilizing beam, said stabilizing beam pivotally connected to said radial stacker conveyor frame.

7. The portable screening machine of claim 2, further comprising a stacking arm pivotable about a first horizontal axis and a providing rotation for a radial stacker about a second vertical axis.

8. The portable screening machine of claim 2, said removable radial stacker conveyor connected to a stacking arm by a ball joint, said ball-joint providing pivotal motion about a vertical axis.

9. The portable screening machine of claim 1 wherein said base support allows radial pivoting includes a wheel base support which pivots below said folding support structure.

10. The portable screening machine of claim 1, wherein said removable radial stacker may be used as a stand alone conveyor.

11. A portable screening machine, comprising:

a chassis having a rotary trommel disposed on said chassis;

an oversized product conveyor at a discharge end of said trommel;

an undersized product belt extending from a rear portion to a forward portion of said chassis, said undersized product belt receiving material from said rotary trommel;

a removable radial stacker conveyor extending from a forward end of said chassis;

said radial stacker rotatably connected to a stacking arm at a forward portion of said chassis;

said stacking arm having a lever arm and a shaft collar integral therewith and providing for rotation of said radial stacker away from said undersized product belt about a horizontal axis from extended configuration;

wherein said removable radial stacker has a folding truss structure which allows radial stacking when said removable radial stacker is connected and disconnected from said chassis.

12. A portable trommel device, comprising:

a chassis having a rotary trommel disposed on said trommel;

said rotary trommel having a input end and a discharge end;

said input end receiving material from a source;

an oversized product conveyor in feeding communication with said discharge end of said rotary trommel;

an undersized product conveyor receiving undersized material radially passing through said trommel and moving said undersized material to a forward end of said chassis;

a radial stacker having a first end and a second end, said radial stacker removably connected to said chassis for stand-alone use and rotatable about a vertical axis for radial stacking;

said radial stacker having a first position wherein said first end receives material from said undersized product conveyor and a second position wherein said first end of said radial stacker is displaced from said undersized product conveyor;

said removable radial stacker supported by a folding support structure having an annular structure allowing support through radial motion of said radial stacker;

said radial stacker stored in said second position in an extended configuration substantially parallel to the length of said chassis.

13. The portable trommel device of claim 12 further comprising a hopper disposed on said chassis and in feeding communication with said rotary trommel.

14. The portable trommel device of claim 12, said oversized product conveyor being foldable.

15. The portable trommel device of claim 14, said oversized product conveyor being rotatable about a horizontal axis.

16. A portable trommel device, comprising:

a portable chassis having a longitudinal length and a rotary trommel mounted thereon;

a hopper supported by said chassis;

a first conveyor receiving material from said hopper and directing to a feed end of said rotary trommel;

a second conveyor receiving material from a discharge end of said rotary trommel, said second conveyor being foldable from an extended position to a stored position;

a third conveyor extending from beneath said rotary trommel to a forward position of said chassis;

a non-folding radial stacking conveyor receiving material from said third conveyor;

said non-folding radial conveyor pivoting about an axis extending through said chassis and spaced from said non-folding radial conveyor about which said non-folding radial stacking conveyor moves when said non-folding radial stacking conveyor pivots from an operating position to a stored position above said chassis;

said non-folding radial conveyor being a detachable from said chassis by releasable pivotal connection.

17. The portable trommel device of claim 16, said non-folding radial stacking conveyor hydraulically driven between said extended position and said stored position.

18. The portable trommel device of claim 16, said non-folding radial stacking conveyor having deployable support members movable between said stored position and said extended position for radial stacking.

19. A portable trommel device, comprising:

a towable chassis having wheels depending from said chassis;

a rotary trommel mounted on said chassis;

a foldable oversized product conveyor pivotally connected to said chassis at a discharge end of said rotary trommel;

a product conveyor receiving material from said rotary trommel and extending toward an end of said chassis;

a non-folding radial stacking conveyor defined by a first material receiving end and a second material discharge end, said non-folding radial stacking conveyor having a first stored position and a second operating position, wherein said first end receives material from said product conveyor in said second position and said non-folding radial stacking conveyor is moved to a position elevated from said second position and extending toward an opposite end of said chassis;

said radial stacking conveyor detachable from said chassis for stand-alone use by releasable connection to parallel stacking arms.

* * * * *